US006568934B1

(12) United States Patent
Butler

(10) Patent No.: US 6,568,934 B1
(45) Date of Patent: May 27, 2003

(54) MESSAGE DISPLAY CANDLE

(76) Inventor: Joshua Neal Butler, 1468 N. Stonehenge Way, Meridian, ID (US) 83642

( * ) Notice: Subject to any disclaimer, the term of this patent is extended or adjusted under 35 U.S.C. 154(b) by 0 days.

(21) Appl. No.: 10/145,923

(22) Filed: May 13, 2002

(51) Int. Cl.[7] ..... F23Q 2/32
(52) U.S. Cl. ..... 431/126; 431/289; 431/253
(58) Field of Search ..... 431/126, 289, 431/253, 291; D26/9

(56) References Cited

U.S. PATENT DOCUMENTS

| | | | | | |
|---|---|---|---|---|---|
| 1,660,760 | A | | 2/1928 | Murphy | |
| 2,279,175 | A | * | 4/1942 | Muench | 431/125 |
| 3,286,492 | A | | 11/1966 | Frazier, Jr. | 67/21 |
| 3,753,643 | A | * | 8/1973 | Golden | 431/126 |
| 3,806,078 | A | | 4/1974 | Achzehner | 249/97 |
| 3,806,723 | A | * | 4/1974 | Ollom | 362/161 |
| 3,881,682 | A | | 5/1975 | Kin | 249/94 |
| 3,907,245 | A | | 9/1975 | Linder | 249/94 |
| 4,304,547 | A | | 12/1981 | Buzil | 431/126 |
| 4,696,640 | A | | 9/1987 | Pitchford | 431/289 |
| 4,830,330 | A | | 5/1989 | Cox et al. | 249/85 |
| 5,597,300 | A | | 1/1997 | Wohl et al. | 431/288 |
| D390,977 | S | | 2/1998 | Vickery, III | D26/7 |
| 6,228,304 | B1 | | 5/2001 | Silbergeld | 264/225 |

* cited by examiner

*Primary Examiner*—Alfred Basichas
(74) *Attorney, Agent, or Firm*—Robert L. Shaver; Frank J. Dykas; Stephen M. Nipper

(57) ABSTRACT

A message display candle in which messages are displayed. In one form of the message display candle, message characters or objects are embedded in combustible transparent gel in the candle body and are visible whether the candle is burning or not. The message of the message display candle can be changed and the message characters can be wax characters in a gel matrix, or formed as part of the bottom or wall of the candle body.

15 Claims, 3 Drawing Sheets

MESSAGE DISPLAY CANDLE

BACKGROUND OF THE INVENTION

1. Field of the Invention

The present invention generally relates to candles, and more particularly relates to candles which display a message or symbol to the user.

2. Background Information

A number of candles have been patented or sold commercially in which some sort of a message may be displayed to a user. This can be in the form of a transparent or translucent scene on the outside of a glass container which holds the wax of the candle. When the candle burns, light from the candle passes through the transparent glass and illuminates the translucent or transparent scene or message. Other display candles reveal their message gradually as the wax of the candle is gradually consumed.

What is lacking is a display candle in which the message is displayed within a wax or gel before any of the wax is consumed. Further, a flame should not be necessary in order to view the candle. Another type of display candle which is lacking is a display candle which is formed of a rigid hollow container filled with a transparent combustible gel or wax in which embedded characters or symbols convey a message. Also needed is a candle which may be refilled with wax or gel without affecting the message, so that the message is permanent and reusable. Also needed is a message candle in which the message may be changed in order to customize it or to periodically change the message.

SUMMARY OF THE INVENTION

These and other objects are accomplished by the message candle of the present invention. A message display candle of the present invention includes a candle body which contains a flammable fuel, which may be a wax, a gel, or an oil. The candle body has a top, a bottom and a side wall and can come in a variety of shapes. One or more message objects are embedded in the wax or gel of the candle body. The device also includes one or more wicks in contact with the wax or gel, and the message display candle is designed so that the message object(s) form a visible message display which is viewable in the candle body. The wick may be anchored to the bottom, but may also be suspended in the fuel so that it doesn't touch the bottom.

In one embodiment of the invention, the message display candle is configured with a rigid and hollow candle body which is filled with a combustible fuel, which is transparent in nature. The message display candle of this embodiment contains message objects or characters, which can take a number of forms. They can be alphanumeric messages and can contain messages which are read by a user. They can be formed as part of the hollow candle body, such as raised characters on the candle body bottom or side wall. The message characters can also be voids in the fuel, which can be shaped in the fuel in various shapes.

In one version of the message display candle, the message characters are formed of a non-transparent wax, gel or oil, which is visible in a matrix of wax or gel, which also may be transparent or otherwise different in appearance than the wax or gel of the message characters. The opacity of the components of the message display candle can also be reversed, with the message characters being transparent in a matrix of non-transparent wax or gel. The message characters, when formed of a gel or wax, may be positioned adjacent to the bottom of the hollow candle body. In such an embodiment, the wick or wicks of the message display candle would be anchored to the bottom of the hollow candle body and extend through the combustible wax or gel. The message characters can also be formed in the wax or gel by filling cavities in the wax or gel with a wax or gel of a different color or opacity than the matrix of the wax or gel.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment regarded as illustrative in nature, and not as restrictive.

DESCRIPTION OF THE PREFERRED EMBODIMENTS

Figure 1:
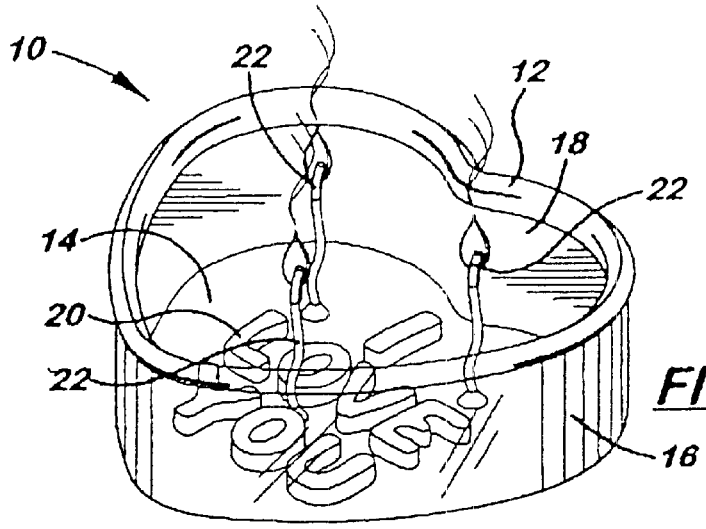
FIG. 1 is a perspective view of the message display candle.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
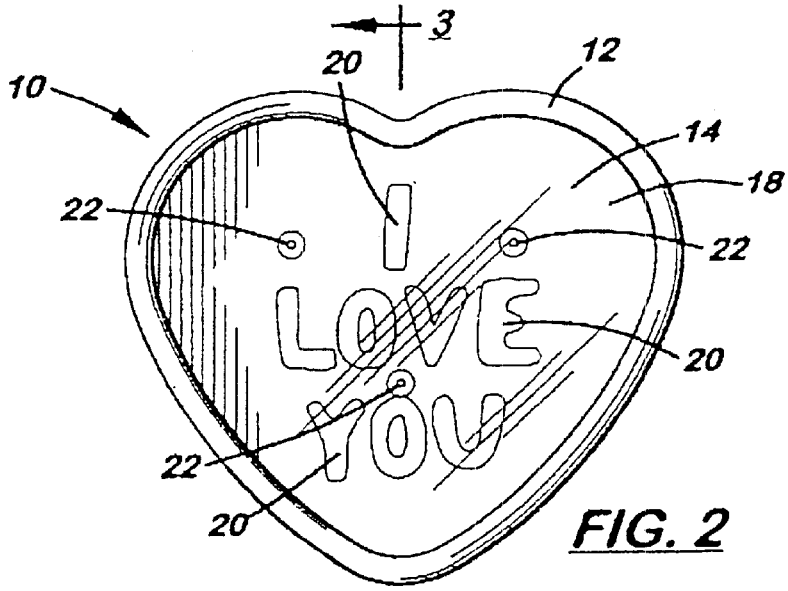
FIG. 2 is a top view of the message display candle.
Figure 3:
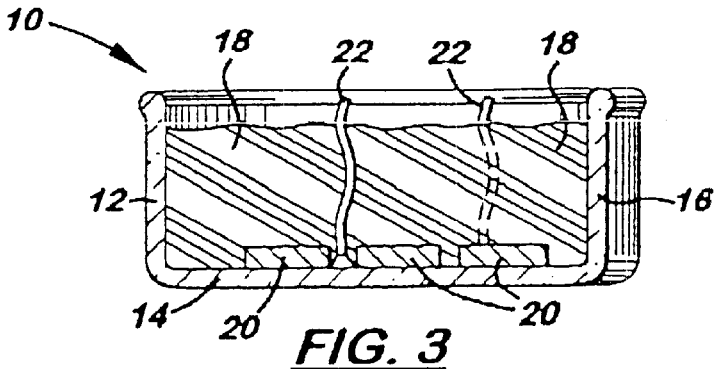
FIG. 3 is a side cutaway view of a version of the message display candle with the characters on the bottom of the candle body.
Figure 4:
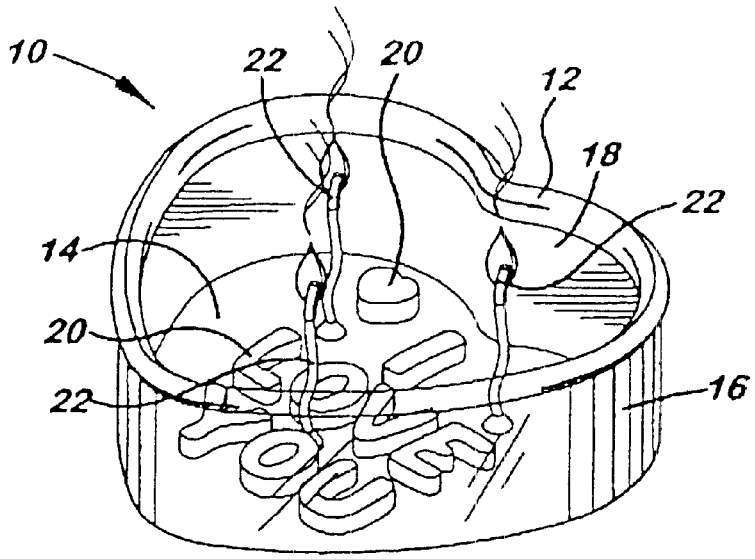
FIG. 4 is a perspective view of a version of the message display candle with a object which is a non-alphanumeric symbol.

Several preferred embodiments of the message display candle of the invention are shown in FIGS. 1 through 9. FIGS. 1, 2 and 3 show an example of the message display candle 10 of the invention in which message objects 20 spell out the message "I Love You." FIG. 4 shows a similar embodiment, and includes a message object 20 in the shape of a heart. In this particular candle, the message body 12 is also in the shape of a heart. Other shapes of the candle body 12 are also possible, including cylindrical, square, triangular, and other shapes, such as clover shaped, flower shaped, leaf shaped, fish shaped, etc. The candle body 12 includes a candle body bottom 14 and a candle body side wall 16. The message display candle 10 shown in FIG. 1 may be filled with a combustible gel 18. Other fuel sources also fall within the scope of the invention, including combustible liquids, such as candle oil, or combustible solids, such as waxes. The fuel of the message display candle will be referred to as gel, with the understanding that any type of combustible fuel could be used in place of the gel.

Figure 5:
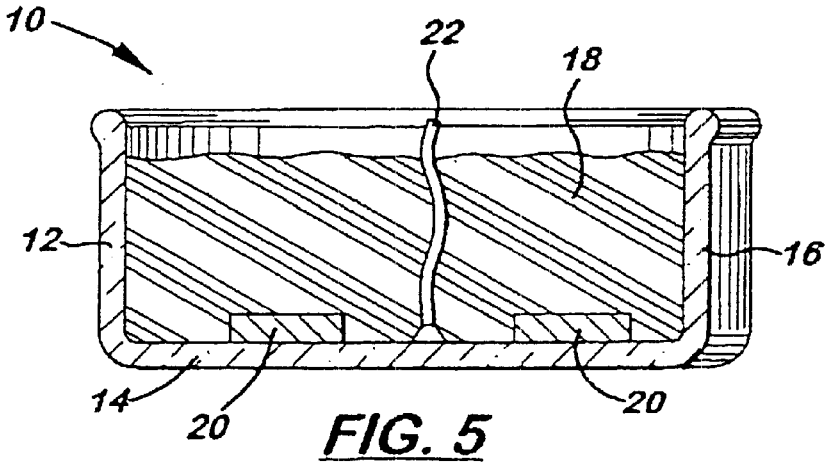
FIG. 5 is a side cutaway view of a version of the message display candle with the characters positioned on the bottom of the candle body.

FIGS. 1 through 9 show various alternative and preferred embodiments of the message display candle of the invention. FIG. 5 shows a message display candle with a configuration similar to that of FIGS. 1, 2 and 4. Message objects 20 are positioned adjacent to the candle body bottom 14 and spell out a message which is visible to the user whether the candle is burning or not. A wick 22 is positioned in the gel 18 and may be lit. The gel 18 provides the fuel for the wick 22. In one variation of the design, the gel 18 is transparent and the message objects may be seen through the gel by the user. The candle body 12 may be made of a transparent glass, plastic, or of opaque materials. In the configuration shown in FIG. 5, the message objects 20 can be removed and replaced by a different message object. The gel 18 can also be refilled after it has burned down sufficiently at the wick 22. The message objects 20 may be made of wax, glass, plastic, or other material. The message candle may also contain engraved text or artwork in the candle body.

Figure 6:
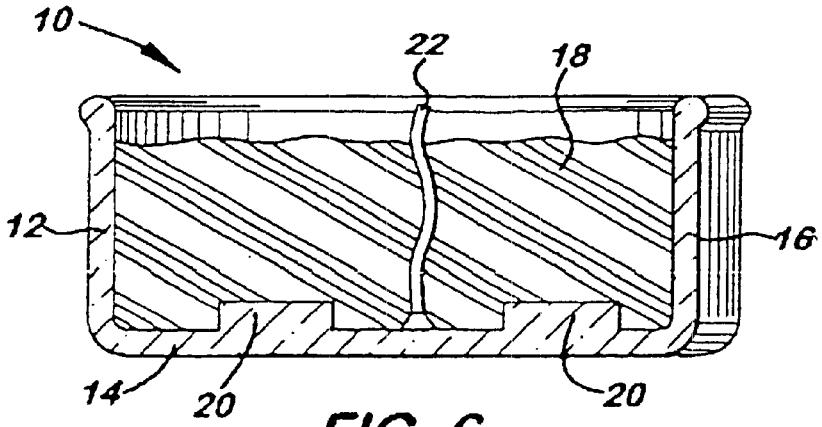
FIG. 6 is a side cutaway view of a version of the message display candle with the characters formed from the bottom of the candle body itself.

FIG. 6 shows another embodiment of the message display candle 10. In this embodiment, the message objects are built into the candle body bottom, and are not changeable. However, the gel 18 may be refilled when it has been sufficiently consumed by the wick 22. The candle body can be made of glass, plastic, acrylic, ceramic, or other suitable material.

Figure 7:
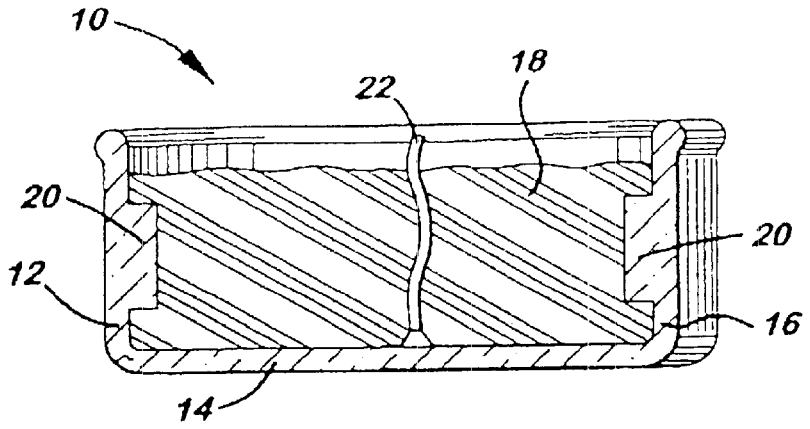
FIG. 7 is a side cutaway view of a version of the message display candle with the characters formed from the material from the side of the candle body itself.

FIG. 7 shows an embodiment of the message display candle in which the message objects are part of the candle body side wall 16. In this embodiment, the message objects 20 are not changeable, but the gel 18 may be replaced when consumed by combustion.

Figure 8:
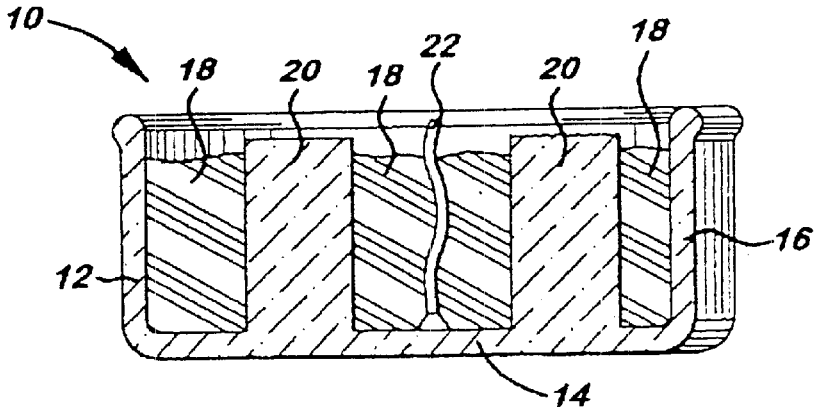
FIG. 8 is a side cutaway view of a version of the message display candle in which the characters are formed from the bottom of the candle body and extend to or above the of the combustible gel or wax.

FIG. 8 shows an embodiment of the message display candle in which the message objects 20 are contiguous with the candle body bottom 14, and rise to a level above the level of the gel 18. As the gel 18 is consumed, the message object would become more and more prominent. As in the other embodiments, the gel 18 may be refilled after it has been consumed.

Figure 9:
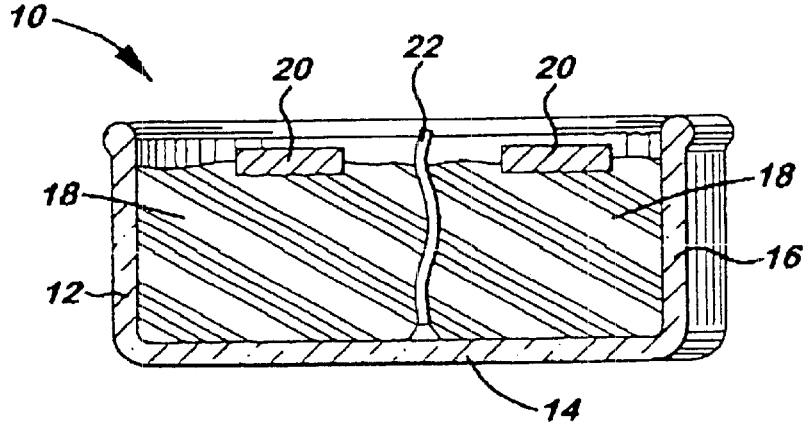
FIG. 9 is a side cutaway view of a version of the message display candle in which the characters float on top of the combustible gel or wax.

FIG. 9 shows an embodiment of the message display candle 10 in which the message objects 20 float on the surface of the gel 18.

The message objects of all of the embodiments shown in the figures can be made of alphanumeric characters or other characters which are symbolic of events or seasons, or objects which are merely decorative. Such objects could include hearts, flowers, animals, birds, character symbols found in alphabet sets, symbols made to resemble photographs such as images of a person's face, images from everyday life such as cars and computers, and other images which can become part of a message or display which would be desirable to place in a candle for viewing.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

I claim:

1. A message display candle, comprising a candle body with a bottom and a side wall, for containing a fuel;

one or more message objects embedded in said fuel and positioned to be visible from above said message display candle but not visible through said side wall of said message display candle;

a fuel in said candle body, for combustion in said candle; and one or more wicks in contact with said fuel;

whereby said one or more message objects forms a visible message display which is viewable in said candle body.

2. The message display candle of claim 1 in which said fuel is a gel.

3. The message display candle of claim 2 in which said gel is transparent in nature.

4. The message display candle of claim 1 in which said candle body further comprises a hollow candle body with a bottom and sides, in which said fuel is contained.

5. The message display candle of claim 4 in which said message objects are alphanumeric message characters.

6. The message display candle if claim 5 in which said message objects are voids defined by said fuel.

7. The message display candle of claim 4 in which said message objects are formed as part of said hollow candle body.

8. The message display candle of claim 6 in which said message characters are formed in said bottom of said hollow candle body.

9. The message display candle of claim 6 in which said message characters are formed in said sides of said hollow candle body.

10. The message display candle of claim 1 in which said message characters are formed of a non-transparent material.

11. The message display candle of claim 1 in which said message characters are formed of a transparent material.

12. The message display candle of claim 4 in which said message characters are positioned adjacent to said bottom of said hollow candle body.

13. The message display candle of claim 11 in which said message characters are positioned adjacent to and spaced apart from said bottom of said hollow candle body.

14. The message display candle of claim 12 in which said message characters are positioned below a level of said fuel of said hollow candle body.

15. A message display candle, comprising a hollow candle body with a bottom and a side wall, for containing a wax or gel;

a plurality of message characters positioned adjacent to said bottom of said hollow candle body and extending approximately a surface of a transparent wax or gel;

a transparent wax or gel in said hollow candle body, for combustion in said candle; and one or more wicks in contact with said transparent wax or gel and anchored to said hollow candle body bottom, and extending through said transparent wax or gel;

whereby said plurality of message characters forms a message which is viewable from above said hollow candle body, and not through said side wall of said message display candle.

* * * * *